US008939098B2

(12) United States Patent
Yeh

(10) Patent No.: US 8,939,098 B2
(45) Date of Patent: Jan. 27, 2015

(54) SEWING MACHINE ACCESSORY FOR CIRCULAR SEWING

(76) Inventor: Fang Chi Yeh, Taipei (TW)

( * ) Notice: Subject to any disclaimer, the term of this patent is extended or adjusted under 35 U.S.C. 154(b) by 702 days.

(21) Appl. No.: 13/373,343

(22) Filed: Nov. 10, 2011

(65) Prior Publication Data

US 2013/0118394 A1 May 16, 2013

(51) Int. Cl.
*D05B 35/10* (2006.01)
*D05B 39/00* (2006.01)

(52) U.S. Cl.
CPC ..... *D05B 35/10* (2013.01); *D05B 39/00* (2013.01)
USPC ..... 112/470.17; 112/257

(58) Field of Classification Search
USPC ..... 112/470.17, 78, 136, 257; 33/11
See application file for complete search history.

(56) References Cited

U.S. PATENT DOCUMENTS

| | | | | | |
|---|---|---|---|---|---|
| 754,320 | A * | 3/1904 | Kiesewetter | 112/151 |
| 1,682,362 | A * | 8/1928 | Von Halle | 2/255 |
| 2,393,050 | A * | 1/1946 | McLellan et al. | 112/470.14 |
| 2,716,952 | A * | 9/1955 | Pasquini et al. | 112/470.11 |
| 2,717,566 | A * | 9/1955 | Szczepanski et al. | 112/470.17 |
| 2,742,006 | A * | 4/1956 | Meissler | 112/66 |
| 2,806,440 | A * | 9/1957 | Schenkengel | 112/103 |
| 2,876,721 | A * | 3/1959 | Burke | 112/148 |
| 3,011,461 | A * | 12/1961 | Johnson | 112/153 |
| 3,046,918 | A * | 7/1962 | Hess | 112/470.17 |
| 3,054,366 | A * | 9/1962 | Cremer | 112/122.1 |
| 3,374,753 | A * | 3/1968 | Rakacs | 112/470.17 |
| 4,325,315 | A * | 4/1982 | Totino et al. | 112/475.19 |
| 5,031,551 | A * | 7/1991 | Graham | 112/63 |
| 5,119,745 | A * | 6/1992 | Terry | 112/470.17 |
| 5,711,236 | A * | 1/1998 | Badger | 112/117 |
| 6,860,211 | B2 * | 3/2005 | Valeriote et al. | 112/117 |
| 7,255,051 | B2 * | 8/2007 | Graham et al. | 112/103 |
| 7,527,005 | B2 * | 5/2009 | Matsumoto et al. | 112/470.17 |
| 7,958,834 | B2 * | 6/2011 | Matsumoto et al. | 112/470.17 |
| 8,146,523 | B2 * | 4/2012 | Matsumoto et al. | 112/470.17 |
| 2005/0103246 | A1 * | 5/2005 | Hasegawa | 112/136 |

* cited by examiner

*Primary Examiner* — Danny Worrell

(57) ABSTRACT

A sewing machine accessory includes a plate for attaching to a sewing machine workbed and to be located below a needle, the plate includes an opening and a guiding track, and a positioning device includes a sliding member slidably engaged with the guiding track of the accessory plate, and a pointed member extended from the sliding member for engaging with a cloth material to be stitched and for forming of an arced stitch on the cloth material, and the pointed member is movable close to the needle for stitching or forming a circular or arced stitch that includes a relatively decreased or smaller outer diameter.

6 Claims, 6 Drawing Sheets

SEWING MACHINE ACCESSORY FOR CIRCULAR SEWING

BACKGROUND OF THE INVENTION

1. Field of the Invention

The present invention relates to a sewing machine accessory, and more particularly to a sewing machine accessory for facilitating or assisting the processes of circular sewing embroidery and the like or the stitching of a circular or arced stitch, and including an improved structure for being easily actuated or operated or adjusted by the user.

2. Description of the Prior Art

Typical sewing machine accessory devices for circular sewing have been developed and provided for attaching or mounting onto a sewing machine for facilitating or assisting the processes of circular sewing embroidery and the like or the stitching of a circular or arced stitch, and comprise an elongated planar work table defining a planar work surface and a plurality of support legs for supporting the work table in general alignment with the end portion of a conventional sewing machine workbed, and a pair of material tacks each having a downwardly extending pointed member for engaging with the material to be stitched.

For example, U.S. Pat. No. 5,119,745 to Terry discloses one of the typical sewing machine accessory devices for circular sewing and comprising an elongated slot running the length of the work surface for engaging with the pointed members of the tacks which pierce and anchor or secure or retain the material or fabric to be stitched on the planar work table.

However, the tacks may not be adjusted or moved close to the needle of the typical sewing machine for stitching of a circular or arced stitch that includes a relatively decreased or smaller outer diameter.

U.S. Pat. No. 7,255,051 to Graham et al., and U.S. Pat. No. 7,958,834 to Matsumoto et al. disclose two other typical templates for use in circular sewing and to assist the process of circular sewing embroidery and the like.

However, the typical templates may not be used for stitching of a circular or arced stitch that includes a relatively decreased or smaller outer diameter.

The present invention has arisen to mitigate and/or obviate the afore-described disadvantages of the conventional sewing machine accessory devices for circular sewing.

SUMMARY OF THE INVENTION

The primary objective of the present invention is to provide a sewing machine accessory provided for facilitating or assisting the processes of circular sewing embroidery and the like or the stitching of a circular or arced stitch.

The other objective of the present invention is to provide a sewing machine accessory including an improved structure for being easily actuated or operated or adjusted by the user.

In accordance with one aspect of the invention, there is provided a sewing machine accessory comprising a plate for attaching to a sewing machine workbed and to be located below a needle, the plate including an opening formed therein, and including a guiding track formed therein, and a positioning device including a sliding member slidably engaged with the guiding track of the accessory plate, and a pointed member extended from the sliding member for engaging with a cloth material to be stitched and for forming of an arced stitch on the cloth material.

The sliding member includes a guide extended therefrom for slidably engaging with the guiding track of the plate and for guiding the sliding member to slide along the guiding track of the plate and to slide toward and away from the opening of the plate.

The guiding track is an elongated slot formed in the plate and defined between two flanges, and the guide includes a pair of grooves oppositely formed in the guide for slidably engaging with the flanges of the plate and for guiding the sliding member to slide along the guiding track of the plate.

The positioning device includes an anchoring member for engaging with the sliding member and for anchoring and retaining the sliding member to the plate at predetermined locations.

The sliding member includes a notch formed therein for engaging with the anchoring member which is engaged between the sliding member and the plate for anchoring and retaining the sliding member to the plate.

The plate includes at least one attaching device attached to bottom for detachably mounting to the sewing machine workbed. The attaching device includes a first layer attached to bottom of the plate, a second layer attached to the first layer, and a third layer attached to the second layer.

The first layer of the attaching device may be selected from an acrylic adhesive layer. The second layer of the attaching device may be selected from a polyethylene terephthalate (PET) layer. The third layer of the attaching device may be selected from a polyurethane (PU) layer.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
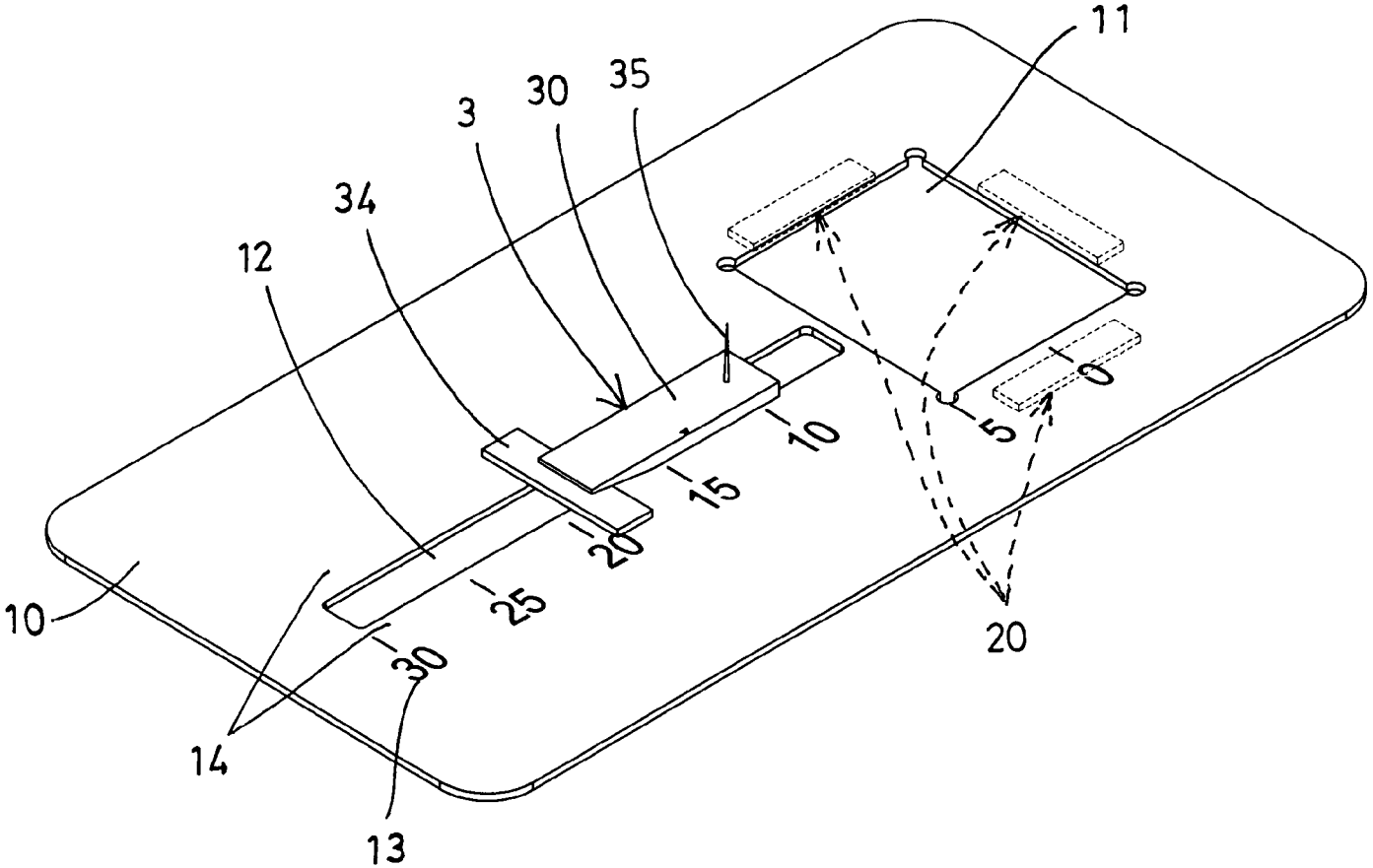
FIG. 1 is a perspective view of a sewing machine accessory for circular sewing in accordance with the present invention.
Figure 2:
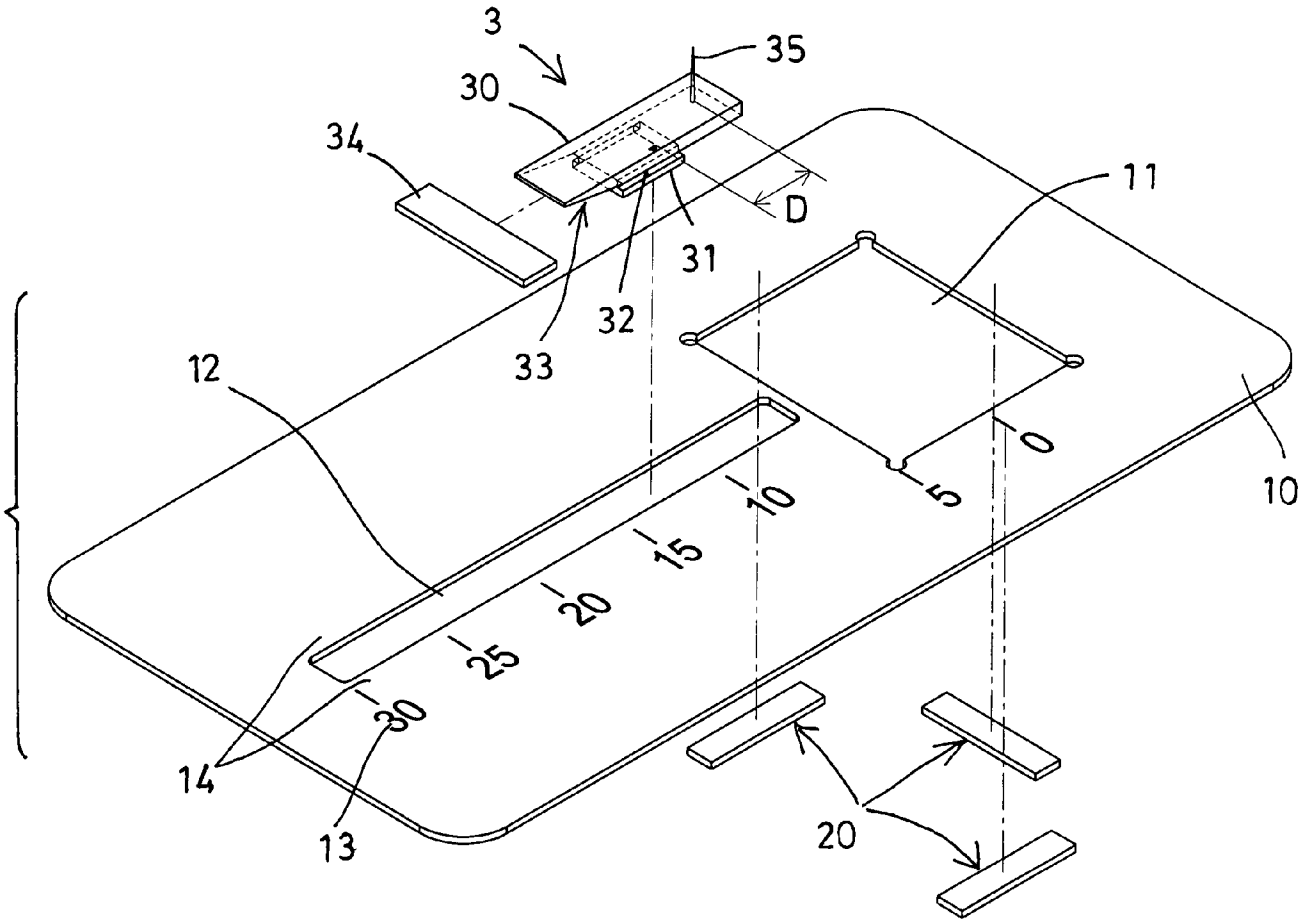
FIG. 2 is an exploded view of the sewing machine accessory for circular sewing.
Figure 3:
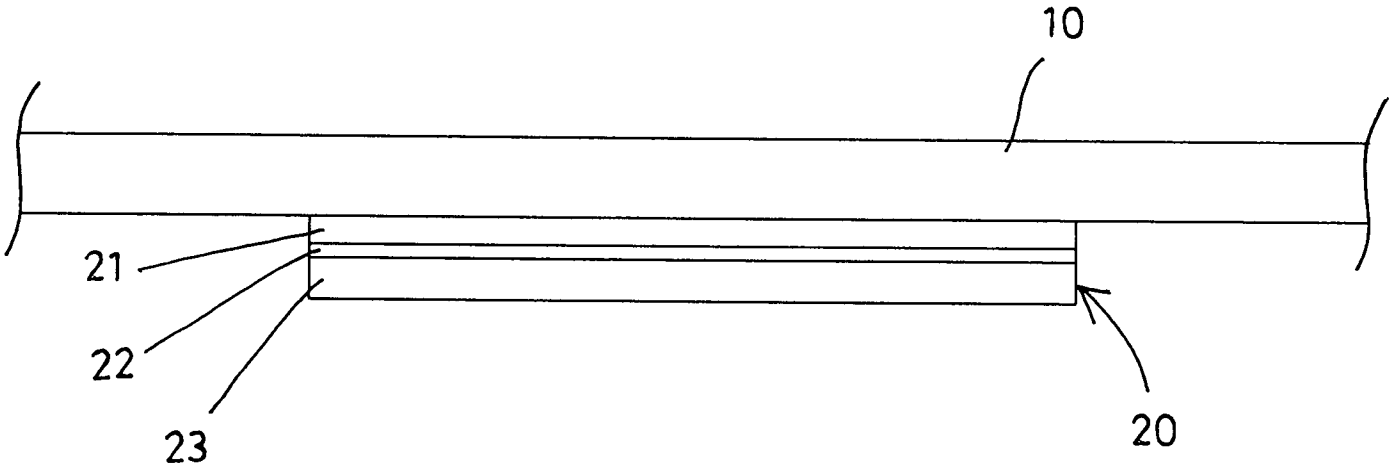
FIG. 3 is a partial plan schematic view of the sewing machine accessory for circular sewing.

Referring to the drawings, and initially to FIGS. 1 and 2, a sewing machine accessory for circular sewing in accordance with the present invention comprises an accessory body or plate 10 for attaching or mounting onto a conventional sewing machine workbed 90 (FIGS. 4-6), and to be disposed or attached or mounted or located below the needle 91, for example, the accessory plate 10 includes an opening 11 formed therein and disposed or located below the needle 91, best shown in FIGS. 4 and 5, and includes one or more (such as three) anchoring or securing or retaining or attaching devices 20 attached or mounted or secured to the bottom of the plate 10 (FIG. 3) for attaching or mounting or securing or anchoring or retaining the accessory plate 10 to or on the sewing machine workbed 90.

For example, the attaching devices 20 may be selected from the magnetic attractive members or magnets, or an adhesive device 20 (FIG. 3) having a first or acrylic adhesive layer 21 for attaching or mounting or securing to the bottom of the plate 10, and having a second or polyethylene terephthalate (PET) layer 22 attached or mounted or secured to the bottom of the first or acrylic adhesive layer 21, and having a third or polyurethane (PU) or adhesive PU soft rubber layer 23 attached or mounted or secured to the bottom of the second or polyethylene terephthalate (PET) layer 22 for temporarily or detachably attaching or mounting or securing to the sewing machine workbed 90, and for disposing or locating the opening 11 of the plate 10 below the needle 91.

The plate 10 includes a mirror-like planar work surface formed thereon for smoothly supporting the material or fabric 80 which may be smoothly pivoted or rotated or moved on the planar work table or the sewing machine workbed 90 and the plate 10, and further includes an elongated slot or guiding track 12 formed therein and directed toward or aligned with the opening 11 of the plate 10, and includes a scale or standard or measurement or graduation 13 formed thereon and located beside the elongated slot or guiding track 12 of the plate 10 for indicating the spacing distance from the needle 91. The plate 10 includes a pair of edges or flanges 14 formed and located beside the elongated slot or guiding track 12 of the plate 10, or the elongated slot or guiding track 12 of the accessory plate 10 is formed or defined between the edges or flanges 14.

A securing or retaining or carrying or positioning device 3 is further provided and includes a sliding member 30 for slidably attaching or mounting or securing onto the accessory plate 10, and includes a protrusion or projection or guide 31 extended downwardly from the sliding member 30 for slidably engaging with the elongated slot or guiding track 12 of the plate 10, and includes a pair of guiding slots or channels or tracks or grooves 32 oppositely formed in the guide 31, or formed and located between the sliding member 30 and the guide 31 for slidably receiving or engaging with the flanges 14 of the plate 10 and for guiding the sliding member 30 to slide along the elongated slot or guiding track 12 of the plate 10 and to slide toward or away from the opening 11 of the plate 10 and the needle 91.

The sliding member 30 may further include a tilted or inclined surface or a tilted or inclined notch 33 formed therein, and the positioning device 3 may further include an anchoring member 34 for engaging with or into the notch 33 of the sliding member 30 and for being engaged between the sliding member 30 and the plate 10, and for anchoring or securing or retaining the sliding member 30 to the plate 10 and for solidly and stably positioning or anchoring or locating the sliding member 30 to the plate 10 at the required or predetermined position or location. The sliding member 30 further includes a needle or pointed member 35 extended upwardly from the sliding member 30 for engaging with the cloth material 80 (FIGS. 4-6) to be stitched and for stitching or forming of a circular or arced stitch on the cloth material 80.

The pointed member 35 is preferably located closer to the opening 11 of the plate 10 and the needle 91, and movable into the range of the opening 11 of the plate 10 for stitching or forming of a circular or arced stitch that includes a relatively decreased or smaller outer diameter. It is preferable that a spacing distance (D, FIG. 2) is provided or formed between the pointed member 35 and the guide 31 for allowing the pointed member 35 to be moved into the range of the opening 11 of the plate 10 (FIG. 5) when the guide 31 has been moved to the end portion of the elongated slot or guiding track 12 of the plate 10 and contacted or engaged with the plate 10. As shown in FIG. 6, the positioning device 3 may further include two boards or plates or discs or panels 36 engaged onto the pointed member 35 for solidly and stably positioning or anchoring or securing or retaining the cloth material 80 on the sliding member 30 and the plate 10 and the sewing machine workbed 90.

For example, a first board or plate or disc or panel 36 is first attached or mounted or engaged onto the pointed member 35, and the cloth material 80 is then engaged onto the pointed member 35, and the second board or plate or disc or panel 37 is then attached or mounted or engaged onto the pointed member 35 and arranged to have the cloth material 80 sandwiched between the panels 36, 37, and for allowing the cloth material 80 to be maintained at a planar status and for preventing the cloth material 80 from being twisted or folded or wrinkled.

Figure 4:
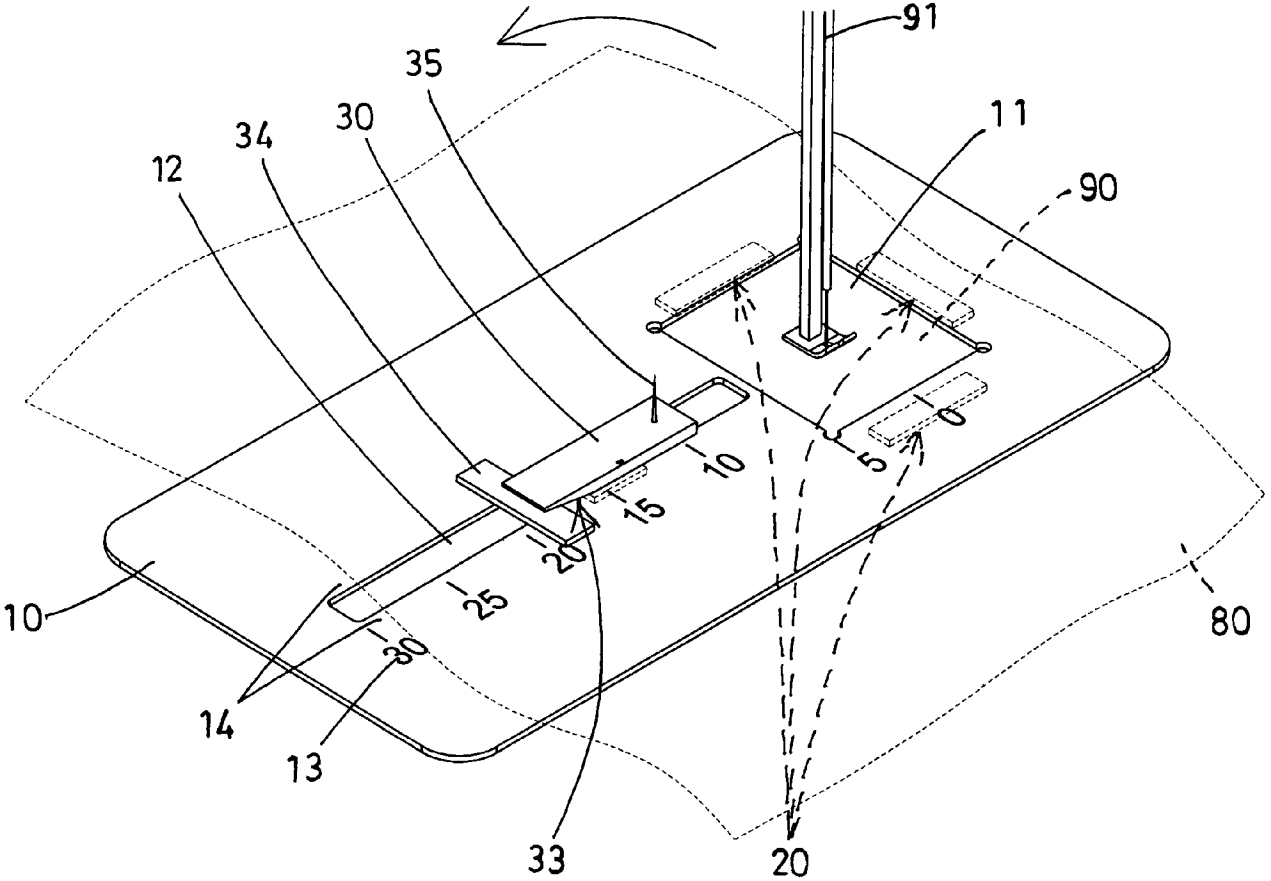
FIG. 4 is another perspective view similar to FIG. 1, illustrating the operation of the sewing machine accessory for circular sewing.
Figure 5:
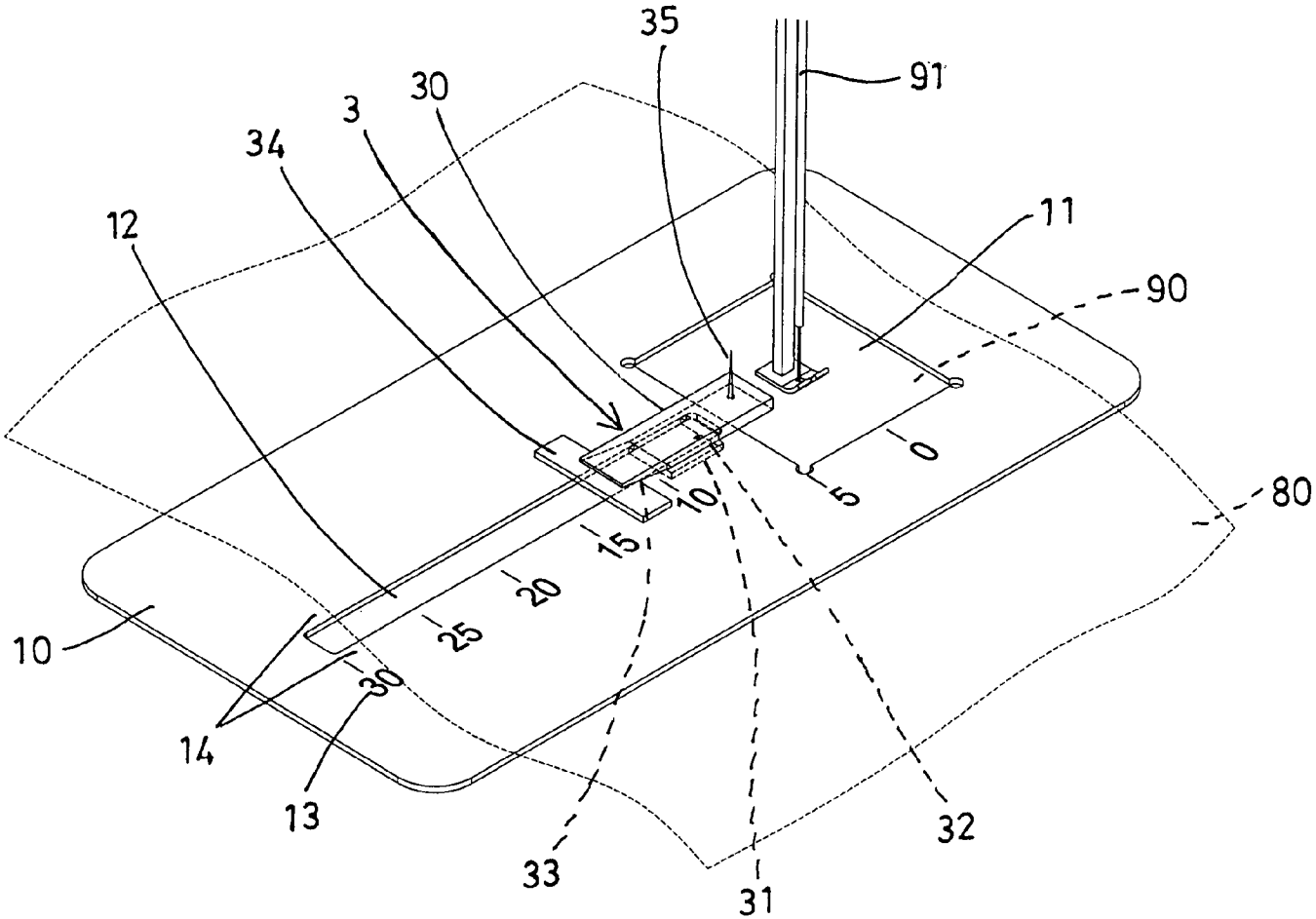
FIG. 5 is a further perspective view similar to FIGS. 1 and 4, illustrating the adjusting operation of the sewing machine accessory for circular sewing.
Figure 6:
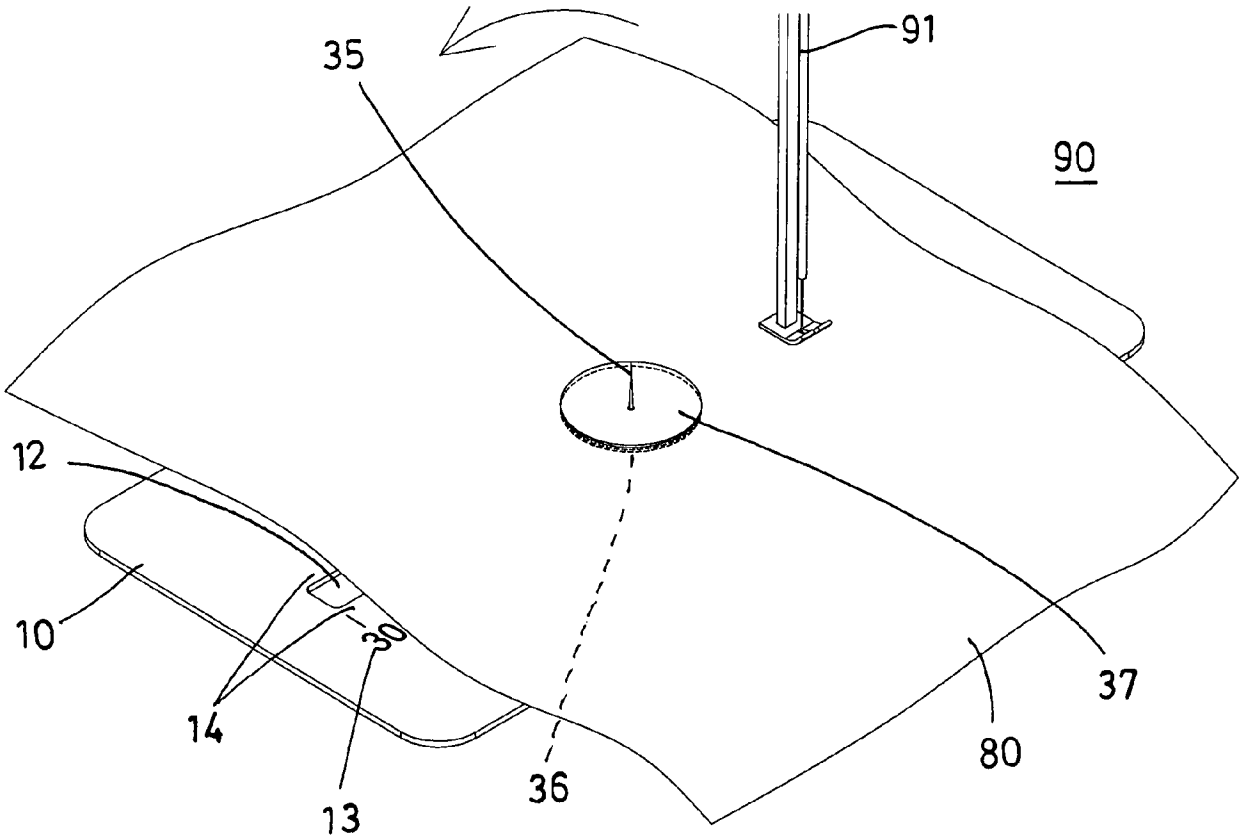
FIG. 6 is a still further perspective view illustrating the other arrangement of the sewing machine accessory for circular sewing.

In operation, as shown in FIGS. 4 and 5, the sliding member 30 may be adjusted or moved relative to the plate 10 and the sewing machine workbed 90 to a selected or predetermined position or location, and the spacing distance from the needle 91 to the pointed member 35 may be provided and indicated with the measurement or graduation 13 that is formed or provided on the plate 10, in addition, the pointed member 35 may be moved and located closer to the opening 11 of the plate 10 and the needle 91, and may also be moved into the range of the opening 11 of the plate 10 for stitching or forming of a circular or arced stitch that includes a relatively decreased or smaller outer diameter.

Accordingly, the sewing machine accessory in accordance with the present invention may be provided for facilitating or assisting the processes of circular sewing embroidery and the like or the stitching of a circular or arced stitch, and includes an improved structure for being easily actuated or operated or adjusted by the user Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sewing machine accessory comprising:

a plate for attaching to a sewing machine workbed and to be located below a needle, said plate including an opening formed therein, and including a guiding track formed therein, and a positioning device including a sliding member slidably engaged with said guiding track of said accessory plate, and a pointed member extended from said sliding member for engaging with a cloth material to be stitched and for forming of an arced stitch on the cloth material;

wherein said sliding member includes a guide extended therefrom for slidably engaging with said guiding track of said plate and for guiding said sliding member to slide along said guiding track of said plate and to slide toward and away from said opening of said plate;

wherein said guiding track is an elongated slot formed in said plate and defined between two flanges, and said guide includes a pair of grooves oppositely formed in said guide for slidably engaging with said flanges of said plate and for guiding said sliding member to slide along said guiding track of said plate;

wherein said positioning device includes an anchoring member for engaging with said sliding member and for anchoring and retaining said sliding member to said plate at predetermined locations;

wherein said sliding member includes a notch formed therein for engaging with said anchoring member which is engaged between said sliding member and said plate for anchoring and retaining said sliding member to said plate.

2. The sewing machine accessory as claimed in claim 1, wherein said plate includes at least one attaching device attached to bottom for detachably mounting to the sewing machine workbed.

3. The sewing machine accessory as claimed in claim 2, wherein said at least one attaching device includes a first layer attached to bottom of the plate, a second layer attached to the first layer, and a third layer attached to the second layer.

4. The sewing machine accessory as claimed in claim 3, wherein said first layer of said at least one attaching device is selected from an acrylic adhesive layer.

5. The sewing machine accessory as claimed in claim 3, wherein said second layer of said at least one attaching device is selected from a polyethylene terephthalate (PET) layer.

6. The sewing machine accessory as claimed in claim 3, wherein said third layer of said at least one attaching device is selected from a polyurethane (PU) layer.

* * * * *